US012685355B2

(12) United States Patent
Muhlenfeld et al.

(10) Patent No.: US 12,685,355 B2
(45) **Date of Patent: *Jul. 21, 2026**

(54) ARTICLE OF APPAREL

(71) Applicant: adidas AG, Herzogenaurach (DE)

(72) Inventors: Stephanie K. Muhlenfeld, Portland, OR (US); Kozet Mitchell, Tygh Valley, OR (US)

(73) Assignee: adidas AG, Herzogenaurach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 19/196,445

(22) Filed: May 1, 2025

(65) Prior Publication Data

US 2025/0255372 A1 Aug. 14, 2025

Related U.S. Application Data

(63) Continuation of application No. 18/441,574, filed on Feb. 14, 2024, now Pat. No. 12,290,121, which is a continuation of application No. 18/050,728, filed on Oct. 28, 2022, now Pat. No. 11,903,435, which is a continuation of application No. 16/659,263, filed on Oct. 21, 2019, now Pat. No. 11,484,076.

(51) Int. Cl.
*A41F 1/00* (2006.01)
*A41C 3/00* (2006.01)

(52) U.S. Cl.
CPC ..... *A41F 1/006* (2013.01); *A41C 3/0014* (2013.01)

(58) Field of Classification Search
CPC ..... A41C 3/0014; A41F 1/006
USPC ..... 450/43
See application file for complete search history.

(56) References Cited

U.S. PATENT DOCUMENTS 6,425,800 B1 * 7/2002 Huang ..... A41C 3/0007 450/41
6,439,959 B1 8/2002 Magrone et al.
6,820,312 B1 11/2004 Senn
6,846,219 B2 1/2005 Moyer
6,875,075 B2 4/2005 Rossi et al.
(Continued)

FOREIGN PATENT DOCUMENTS

CA 2281062 A1 2/2001
FR 3030197 B1 12/2017
(Continued)

OTHER PUBLICATIONS

Extended European Search Report for European Application No. 20202803.1, mailed Mar. 19, 2021, 9 pages.

*Primary Examiner* — Gloria M Hale
(74) *Attorney, Agent, or Firm* — Sterne, Kessler, Goldstein & Fox P.L.L.C.

(57) ABSTRACT

A bra including a closure system, the closure system including a first layered fabric body, a second layered fabric body, a loop assembly secured to the first layered fabric body, and a hook assembly secured to the second layered fabric body. The hook assembly is configured to interface with the loop assembly to secure the first layered fabric body to the second layered fabric body, and the first layered fabric body includes a flexible supporting layer, where the flexible supporting layer is configured to provide rigidity to the second layered fabric body such that the second layered fabric body maintains a flat configuration when it is secured to the first layered fabric body.

21 Claims, 18 Drawing Sheets

(56) References Cited

U.S. PATENT DOCUMENTS

| | | | |
|---|---|---|---|
| 6,966,815 | B2 | 11/2005 | Weinerth |
| 7,086,925 | B2 | 8/2006 | Kaye et al. |
| 7,128,635 | B1 | 10/2006 | Liu |
| 7,604,526 | B2 | 10/2009 | Liu |
| 7,682,219 | B2 | 3/2010 | Falla |
| 7,722,433 | B2 | 5/2010 | Utaka |
| 7,841,924 | B2 | 11/2010 | Wan |
| 7,882,605 | B2 | 2/2011 | Senn |
| 8,105,130 | B2 | 1/2012 | Fildan et al. |
| 8,186,025 | B2 | 5/2012 | Fildan et al. |
| 8,359,718 | B2 | 1/2013 | Yeung |
| 9,386,808 | B2 | 7/2016 | Turlan-Van Der Hoeven |
| 11,484,076 | B2 | 11/2022 | Muhlenfeld et al. |
| 11,903,435 | B2 | 2/2024 | Muhlenfeld et al. |
| 12,290,121 | B2 * | 5/2025 | Muhlenfeld ..... A41C 3/0014 |
| 2009/0223029 | A1 | 9/2009 | Leung |
| 2009/0300824 | A1 | 12/2009 | Yeung |
| 2010/0317256 | A1 | 12/2010 | Zhang |
| 2011/0283489 | A1 | 11/2011 | Yeung |
| 2013/0068147 | A1 | 3/2013 | Cheung |
| 2014/0317894 | A1 | 10/2014 | Pirker |
| 2021/0112899 | A1 | 4/2021 | Muhlenfeld et al. |
| 2024/0180276 | A1 | 6/2024 | Muhlenfeld et al. |

FOREIGN PATENT DOCUMENTS

| | | | |
|---|---|---|---|
| GB | 2503703 | B | 3/2017 |
| JP | 2005054281 | A | 3/2005 |
| JP | 5835782 | B2 | 12/2015 |
| WO | WO-2008093443 | A1 | 8/2008 |

* cited by examiner

ARTICLE OF APPAREL

CROSS-REFERENCE TO RELATED APPLICATIONS

This application is a continuation application of U.S. patent application Ser. No. 18/441,574, filed Feb. 14, 2024, now U.S. Pat. No. 12,290,121, which is a continuation application of U.S. patent application Ser. No. 18/050,728, filed Oct. 28, 2022, now U.S. Pat. No. 11,903,435, which is a continuation of U.S. patent application Ser. No. 16/659,263, filed Oct. 21, 2019, now U.S. Pat. No. 11,484,076. All of these applications are incorporated herein in their entirety by reference thereto.

FIELD

The present disclosure relates to articles of apparel. In particular, the present disclosure relates to bras.

BACKGROUND

Closures for securing the back panels of bras are typically difficult to clasp. These closures generally include very small fastening components which cannot easily be clasped together, particularly if a wearer cannot see the closure. Accordingly, bras often need to be put on backwards and clasped in the front of the wearer's body, such that the wearer can see the closure, before being turned around. Because bras tend to fit snugly, turning a clasped bra around the torso can cause uncomfortable rubbing against the skin. Furthermore, the tensile stresses applied to these small fastening components can cause the closures to wear out quickly, or even tear, since the stresses are concentrated in such small areas. To improve the stress distribution across the closure systems, additional fastening components can be included in the closures. However, a greater number of closure components can cause the closure system to be even more difficult to clasp.

Additionally, bras commonly incorporate a variety of construction techniques to shape and stabilize breast tissue. One of the most common construction techniques is the incorporation of underwire structures into the bras to assist with fit and to help create a consistent breast shape. These underwire structures often have a continuous, narrow width, and circumscribe the sides and lower edges of the wearer's breast tissue. This can restrict movement of the breast tissue, but does not stabilize or shape the breast tissue that is enveloped by the bra cups. Any shaping of the breast tissue is achieved by compression of the breasts within the cups. However, shaping of the breast tissue within the cups is heavily reliant on the proper fit of the cup. If the breast tissue does not completely fill the cup, the tissue may pool at the bottom of the cup and overlap the underwire creating an undesirable shape. Furthermore, the underwire structures have many other disadvantages, such as rubbing and poking, which causes discomfort to the wearer.

BRIEF SUMMARY OF THE INVENTION

The present disclosure is directed to bras, particularly sports bras, that include closure systems that are easier to clasp than conventional bra closure systems. In some embodiments, a closure system includes a hook assembly attached to a rigid supporting layer. In some embodiments, the closure system further includes a loop assembly including enlarged loops.

Some embodiments are directed to a bra including a closure system, the closure system including a first layered fabric body, a second layered fabric body, a loop assembly secured to the first layered fabric body, and a hook assembly secured to the second layered fabric body, where the hook assembly is configured to interface with the loop assembly to secure the first layered fabric body to the second layered fabric body, where the second layered fabric body comprises a flexible supporting layer, and where the flexible supporting layer is configured to provide rigidity to the second layered fabric body such that the second layered fabric body maintains a flat configuration when it is secured to the first layered fabric body.

Some embodiments are directed to a closure system for a bra, the closure system including a loop assembly secured to a first layered fabric body, the first layered fabric body including a top fabric layer, a top adhesive layer disposed on a bottom face of the top fabric layer, a bottom fabric layer, a bottom adhesive layer disposed on a top face of the bottom fabric layer, and a cushioning layer disposed between the top adhesive layer and the bottom adhesive layer, where the top adhesive layer and the bottom adhesive layer are configured to secure the flexible supporting layer between the top fabric layer and the bottom fabric layer; and a hook assembly secured to a second layered fabric body, the second layered body including a top fabric layer, a top adhesive layer disposed on a bottom face of the top fabric layer, a bottom fabric layer, a bottom adhesive layer disposed on a top face of the bottom fabric layer, and a flexible supporting layer disposed between the top adhesive layer and the bottom adhesive layer, where the top adhesive layer and the bottom adhesive layer are configured to secure the flexible supporting layer between the top fabric layer and the bottom fabric layer, and where the hook assembly is configured to interface with the loop assembly to secure the first layered fabric body to the second layered fabric body.

Some embodiments are directed to a bra including a closure system, the closure system including a first layered fabric body, a second layered fabric body, a loop assembly secured to the first layered fabric body, the loop assembly including a plurality of loops, where each of the hooks has an aspect ratio of at least 2:1, a hook assembly secured to the second layered fabric body, the hook assembly including a plurality of hooks, where each of the hooks has an aspect ratio of at least 1:1, where the hook assembly is configured to interface with the loop assembly to secure the first layered fabric body to the second layered fabric body, where the second layered fabric body includes a flexible supporting layer, and where each of the loops extends perpendicularly outward from a top surface of the first layered fabric body.

BRIEF DESCRIPTION OF THE DRAWINGS/FIGURES

DETAILED DESCRIPTION OF THE INVENTION

Figure 1B:
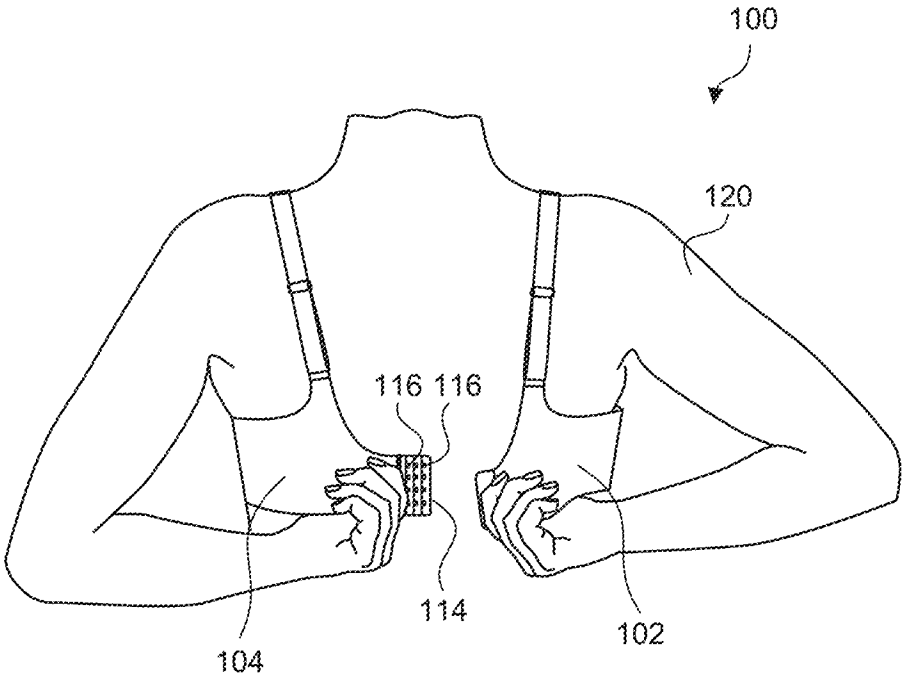
FIG. 1B PRIOR ART
FIG. 1B illustrates the bra of FIG. 1A in use.

The present invention(s) will now be described in detail with reference to embodiments thereof as illustrated in the accompanying drawings. References to "some embodiments", "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. In the drawings, like reference numbers generally indicate identical, functionally similar, and/or structurally similar elements. Additionally, generally, the left-most digit(s) of a reference number identifies the drawing in which the reference number first appears.

Figure 1A:
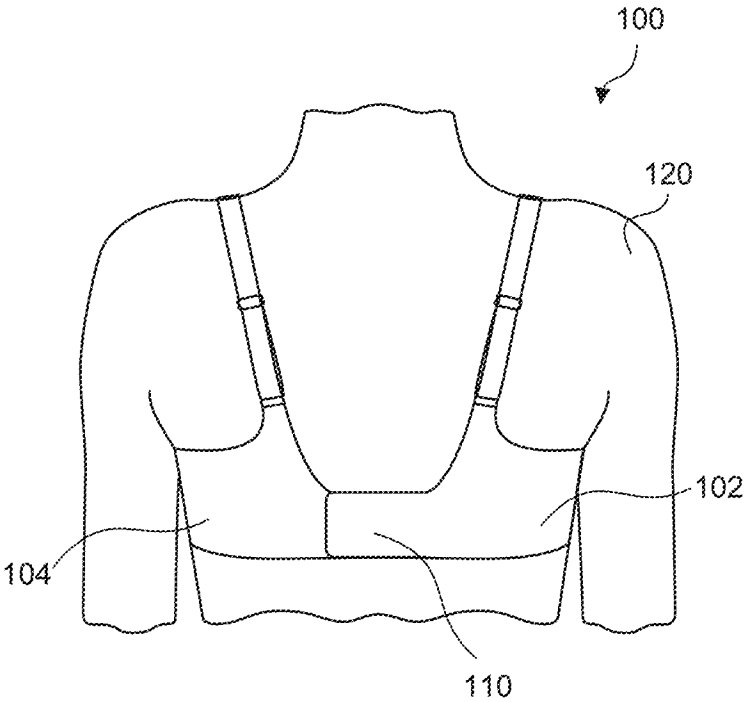
FIG. 1A PRIOR ART
FIG. 1A illustrates a bra according to the prior art.

The closure systems typically included on bras are difficult for wearers to clasp for a number of reasons. For example, FIGS. 1A and 1B, which are meant to be exemplary only, show a bra 100 including a conventional closure system 110. As shown in FIG. 1B, in order for a wearer 120 to fasten bra panels 102 and 104 together, she must grasp hook assembly 112 at its end such that she is holding the entirety of hook assembly 112 in her hand. This causes at least two problems—first, the wearer's thumb can get in the way of the hooks and can contort the hook assembly making alignment difficult, and second, it causes the wearer's arm to be positioned awkwardly such that her shoulder is strained. However, if she were to hold hook assembly 112 any further away from its edge, she would not have sufficient control to align and couple together the hooks with eyes 116 within loop assembly 114. Consequently, there exists a need for a bra having a closure system that is easy for the wearer to clasp without straining her arm.

Accordingly, in some embodiments described herein, a bra having a closure system designed to be easily clasped is provided. For example, in contrast to the bra shown in FIGS. 1A and 1B, the bra shown in FIGS. 2A and 2B may allow a wearer 220 to grasp hook assembly 212 at a point much closer to the side of her body. This may be accomplished by providing rigidity to hook assembly 212 through incorporation of a flexible supporting layer within hook assembly 212. Because hook assembly 212 is rigid, the wearer does not need to provide support with her hand while fastening panels 202 and 204 together, which prevents her thumb from getting in the way of the hooks and reduces the strain on her shoulder. Furthermore, the hooks in hook assembly 212 and the loops 216 in loop assembly 214 may be much larger than, for example, the hooks and loops included in conventional closure system 110. This size increase may facilitate alignment of the hooks with the loops, and it may also reduce the tensile stresses across the closure system, since the stresses are distributed across larger areas. By reducing these applied stresses, the life of the bra may be extended.

Figure 2B:
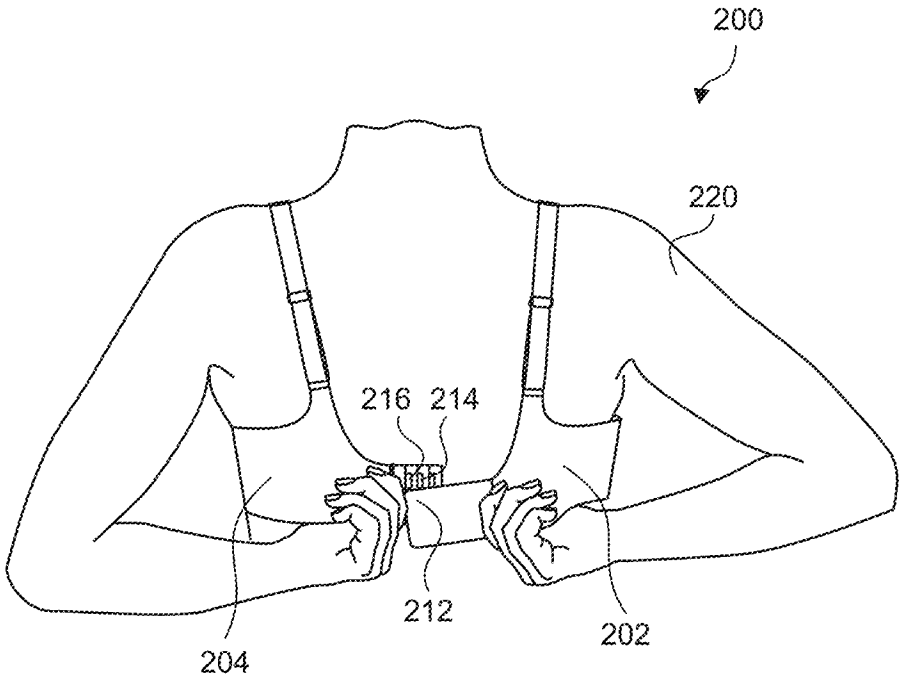
FIG. 2B illustrates the bra of FIG. 2A in use.
Figure 2A:
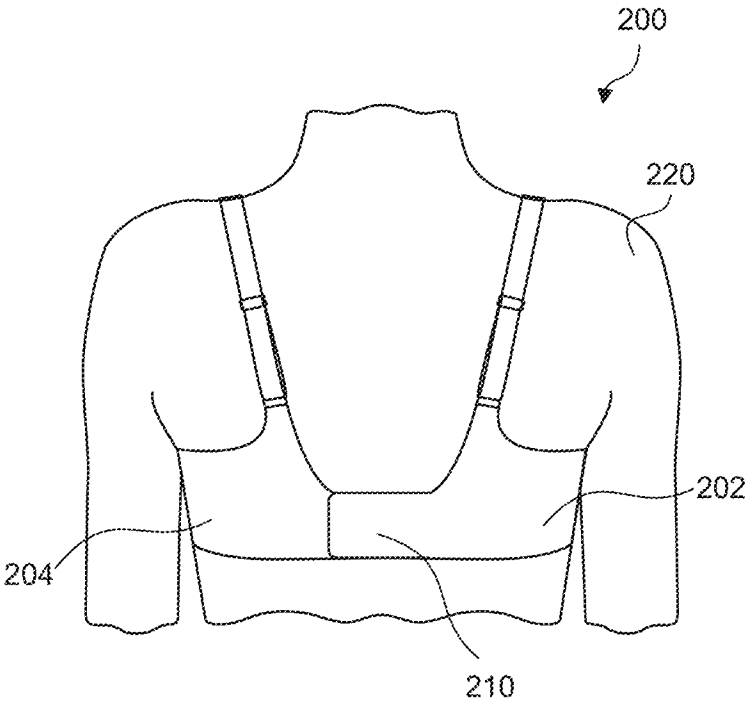
FIG. 2A illustrates a bra according to some embodiments.

For example, in one embodiment, as shown in FIGS. 2A and 2B, bra 200 includes a closure system 210 configured to connect together a first bra panel 202 and a second bra panel 204. In some embodiments, closure system 210 includes a hook assembly 212 and a loop assembly 214. Loop assembly 214 may be secured to a first layered fabric body configured to be coupled to first bra panel 204, for example as shown in FIGS. 3D and 4D, and hook assembly 212 may be secured to a second layered fabric body configured to be coupled to a second bra panel 202, for example as shown in FIG. 3D. The layered fabric bodies may be formed as tabs or flaps. In some embodiments, hook assembly 212 is configured to interface with loop assembly 214 to secure first bra panel 204 to second bra panel 202 in order to fasten the bra. In some embodiments, the first layered fabric body and the second layered fabric body overlap when hook assembly 212 interfaces with loop assembly 214. FIGS. 3A-3D show details of a loop assembly 300, which may correspond to loop assembly 214, according to some embodiments. For example, as shown in FIGS. 3A and 3B, loop assembly 300 may include a plurality of elongated loops 310 coupled to a top face 302 of loop assembly 300. Loop assembly 300 may further include a bottom face 304 opposite top face 302, which may contact a wearer's skin. In some embodiments, loops 310 are assembled in rows, and are evenly spaced apart along the length of loop assembly 300.

In some embodiments, loops 310 have an aspect ratio of at least 2:1. As used herein, "aspect ratio" means the ratio between the length and the width of a component. For example, in some embodiments, length 314 of loops 310 is at least twice as long as width 312 of loops 310. In some embodiments, length 314 is at least 1 cm, which is double the length of a typical eye used in conventional bra closure systems. In some embodiments, width 310 is 0.5 cm.

Figure 3C:
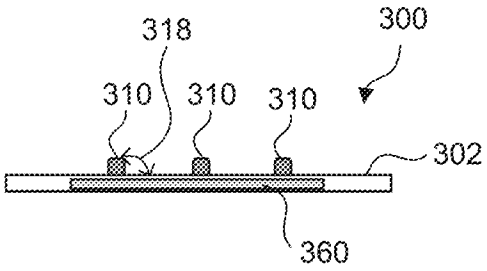
FIG. 3C illustrates a side view of the loop assembly system of FIG. 3A.
Figure 3D:
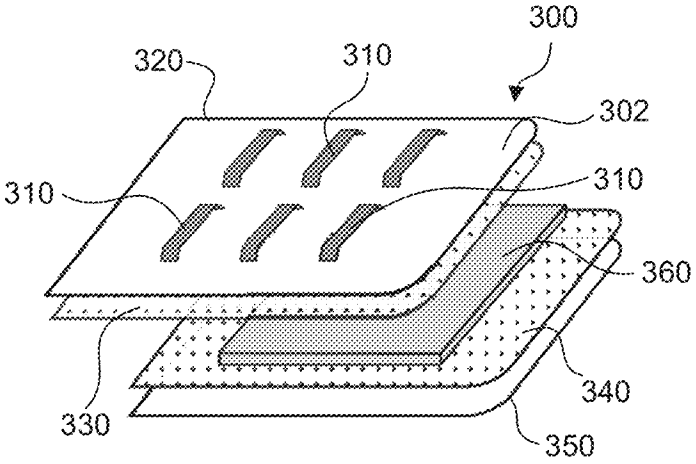
FIG. 3D illustrates an exploded view of the loop assembly of FIG. 3A.
Figure 3A:
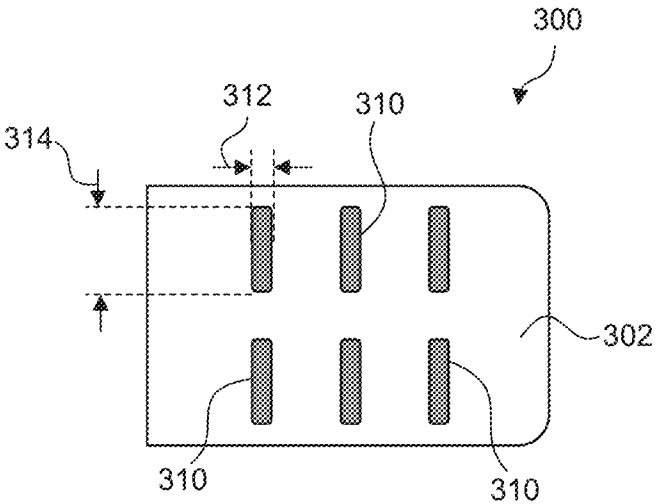
FIG. 3A illustrates a top view of a loop assembly of a closure system for a bra according to some embodiments.
Figure 3B:
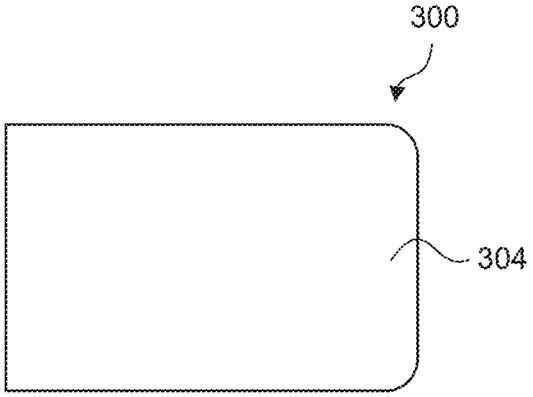
FIG. 3B illustrates a bottom view of the loop assembly of FIG. 3A.
Figure 4C:
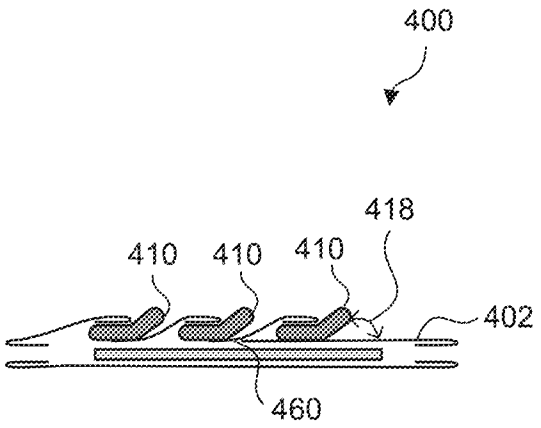
FIG. 4C illustrates a side view of the loop assembly system of FIG. 4A.
Figure 4D:
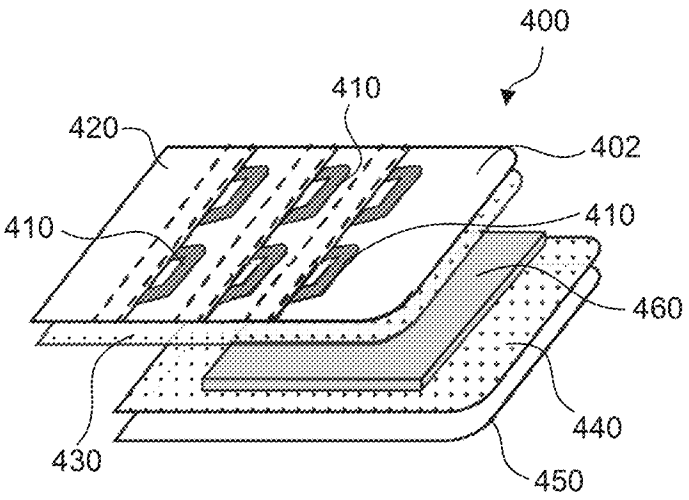
FIG. 4D illustrates an exploded view of the loop assembly of FIG. 4A.
Figure 4A:
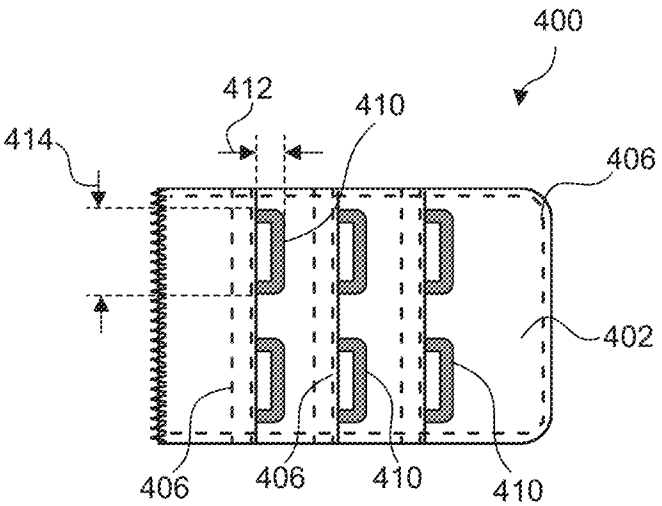
FIG. 4A illustrates a top view of a loop assembly of a closure system for a bra according to some embodiments.
Figure 4B:
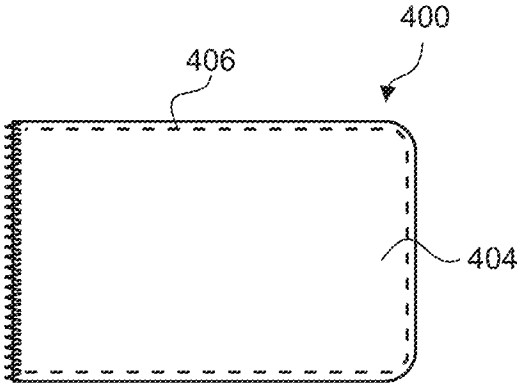
FIG. 4B illustrates a bottom view of the loop assembly of FIG. 4A.

As shown in FIGS. 3C and 3D, loop assembly 300 may be a layered fabric body. For example, in some embodiments, loop assembly 300 includes a top body fabric layer 320 on which loops 310 are disposed, and a bottom body fabric layer 350, and a foam layer 360 disposed between top body fabric layer 320 and bottom body fabric layer 350. Top adhesive layer 330 may connect top body fabric layer 320 to a top face of foam layer 360, and bottom adhesive layer 340 may connect bottom body fabric layer 350 to a bottom face foam layer 360. In some embodiments, foam layer 360 provides cushioning to ensure comfort of the wearer. Foam layer 360 may also provide stiffness to loop assembly 300.

In some embodiments, an angle 318 between a top face of loops 310 and top face of loop assembly 302 is 90°±5°. In some embodiments, loops 310 extend perpendicularly outward from a top face 302.

In some embodiments, an angle between a top face of the loops and the top face of the loop assembly may be smaller than 90°, and greater than 30°. For example, as shown in FIGS. 4A-4D, an angle 418, between a top face of loops 410 and a top face 402 of loop assembly 400, may be 85°, 80°, 75°, 70°, 65°, 60°, 55°, 50°, 45°, 40°, or 35°, or within a range having any two of these values as endpoints, inclusive of the endpoints. Ensuring that the loops are raised away from the top face of the loop assembly prevents the need for the wearer to bend the loop assembly in order to lift the loops away from the top face such that the hooks may be inserted. This increases case of fastening. Furthermore, bending the loops to an angle allows for the loops to be set into a traditional seam on loop assembly 400, which enables loop assembly 400 to be manufactured using existing industry machinery, thereby reducing production costs. Alternatively, loop assembly 400 may be manufactured using modified existing industry machinery, which may be optimized for production of the loop assembly. Or, loop assembly 400 may be manufactured using apparel or soft goods industry machinery that is not typically used to produce women's undergarments such that typical machinery for manufacturing bras is not necessary. Accordingly, additional equipment may not need to be purchased in order to manufacture the loop assembly, thereby reducing production costs.

Loop assembly 400 may also include a bottom face 404. In some embodiments, loop assembly 400 is a layered fabric body, similar to loop assembly 300. For example, loop assembly 400 may include a top body fabric layer 420, a bottom body fabric layer 450, and a foam layer 460 disposed between top body fabric layer 420 and bottom body fabric layer 450. Top adhesive layer 430 may connect top body fabric layer 420 to foam layer 460, and bottom adhesive layer 440 may connect bottom body fabric layer 450 to foam layer 460. However, in some embodiments, loop assembly 400 is reinforced by stitching 406 around the perimeter of loop assembly 400, and over the ends of loops 410, thereby securing the loops to the loop assembly.

An aspect ratio of loops 410 may be similar to the aspect ratio of loops 310. For example, loops 410 may have an aspect ratio of at least 2:1 such that, in some embodiments, length 414 of loops 410 is at least twice as long as width 412 of loop 410. In some embodiments, length 414 is at least 1 cm. In some embodiments, width 410 is 0.5 cm.

FIGS. 5A-5D show details of a hook assembly 500, which may correspond to hook assembly 212, shown in FIG. 2. Hook assembly 500 may include a plurality of hooks disposed on a bottom face 504 of hook assembly 500. Hook assembly 500 may further include a top face 502, which may be the outermost facing surface of hook assembly 500. In some embodiments a design may be included on top face 502. For example, in some embodiments, top face 502 includes at least one of a logo, a brand name, a monogram, or any other desired design. In some embodiments the design is either screen printed, embroidered, embossed, debossed, heat set, or laminated onto top surface 502. However, any method suitable to add a design to a fabric may be used.

Figure 6B:
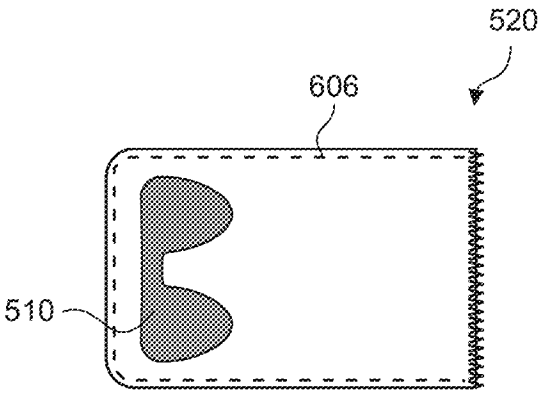
FIG. 6B illustrates a bottom view of the hook assembly of FIG. 6A.
Figure 6A:
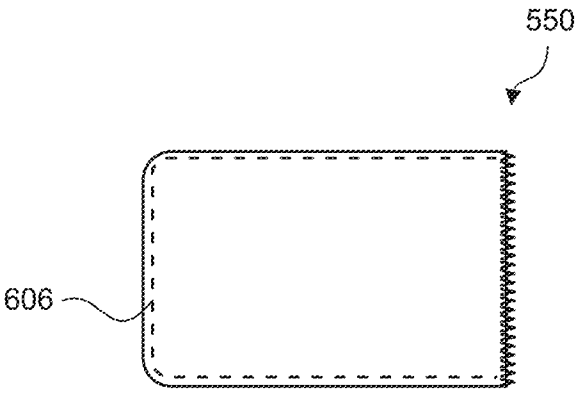
FIG. 6A illustrates a top view of a hook assembly of a closure system for a bra according to some embodiments.

In some embodiments, hook assembly 500 is a layered fabric body. For example, hook assembly 500 may include a top fabric layer 520, a bottom fabric layer 550, and a flexible supporting layer 560 disposed between top fabric layer 520 and bottom fabric layer 550. In some embodiments, hooks 510 extend through a plurality of slits within top fabric layer 520. In some embodiments, top body fabric layer is attached to supporting layer 560 by top adhesive layer 530, and bottom body fabric layer is attached to supporting layer 560 by bottom adhesive layer 540. In some embodiments, for example as shown in FIGS. 6A and 6B, top fabric layer 520 and bottom fabric layer 550 are sewn together. Stitching 606 may reinforce hook assembly 500 and provide additional durability. However, in some embodiments, top fabric layer 520 and bottom fabric layer 550 are joined by bonding, lamination, or ultrasonic attachment, or through any other process suitable for joining two layers of fabric.

Flexible supporting member 560 may provide rigidity to hook assembly 500, which allows for hook assembly 500 to have a length 506 which is significantly greater than a length of a conventional hook assembly typically used in bras. In some embodiments, a length 508 of flexible supporting member 560 is in a range of 5 cm to 20 cm, including subranges. For example, flexible supporting member 560 may have a length of 5 cm, 6 cm, 7 cm, 8 cm, 9 cm, 10 cm, 11 cm, 12 cm, 13 cm, 14 cm, 15 cm, 16 cm, 17 cm, 18 cm, 19 cm, 20 cm, or within a range having any of these values as endpoints, inclusive of the endpoints. In some embodiments, a width 507 of flexible supporting member 560 is in a range of 1 cm to 20 cm, including subranges. For example, flexible supporting member 560 may have a width of 1 cm, 1.7 cm, 2 cm, 3 cm, 4 cm, 5 cm, or 6 cm, 7 cm, 8 cm, 9 cm, 10 cm, 11 cm, 12 cm, 13 cm, 14 cm, 15 cm, 16 cm, 17 cm, 18 cm, 19 cm, or 20 cm, or within a range having any two of these values as endpoints, inclusive of the endpoints. The rigidity provided by flexible supporting member 560 may also enable hook assembly 500 to maintain a flat configuration when coupled with a loop assembly. This flat configuration may help ensure comfort of the wearer and may provide a sleek, neat look.

In some embodiments, flexible supporting member 560 includes a plurality of slots, or perforations, 562. Slots 562 may reduce the weight of flexible supporting member 560 for enhanced comfort of the wearer.

Figure 5A:
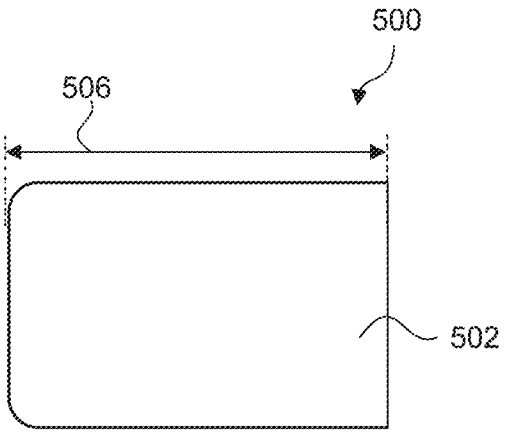
FIG. 5A illustrates a top view of a hook assembly of a closure system for a bra according to some embodiments.
Figure 5B:
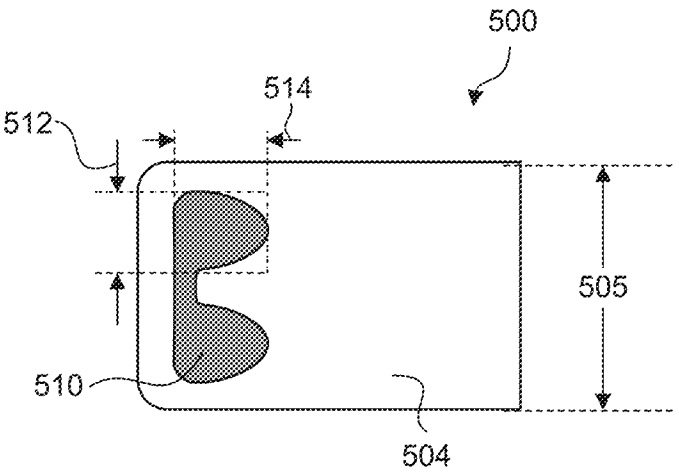
FIG. 5B illustrates a bottom view of the hook assembly of FIG. 5A.
Figure 5C:
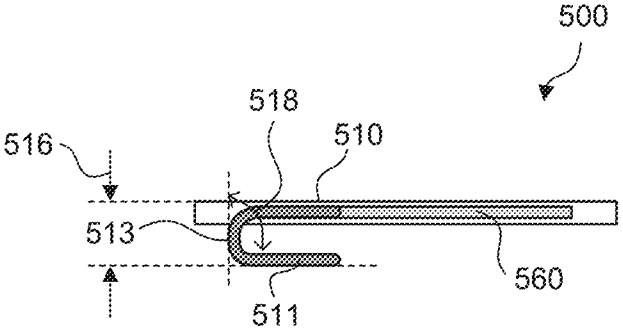
FIG. 5C illustrates a side view of the hook assembly system of FIG. 5A.
Figure 5D:
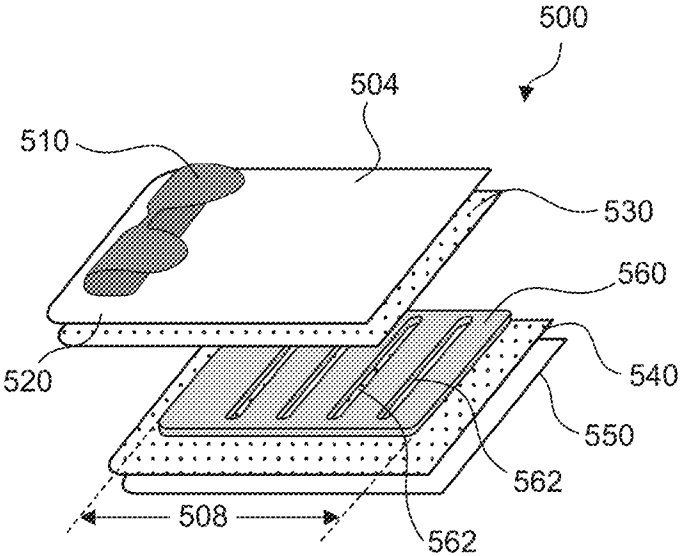
FIG. 5D illustrates an exploded view of the hook assembly of FIG. 5A.

In some embodiments, for example as shown in FIG. 5C, hooks 510 are fixed into flexible supporting layer 560. Coupling hooks 510 with supporting layer 560 in this way provides enhanced stability and rigidity to the hooks, which may improve the case of clasping the closure system, since the wearer does not need to worry about the hooks bending or warping.

In some embodiments, flexible supporting layer 560 is made from a flexible polymer. For example, flexible supporting layer 560 may be made from a thermoplastic polyurethane (TPU), a thermoplastic rubber (TPR), a thermoplastic elastomer (TPE), nylon, a carbon-based material, fiber glass, or any other material suitable for injection molding.

In some embodiments, flexible supporting layer 560 is disposed between top fabric layer 520 and bottom fabric layer 550. However, alternative configurations may be used. For example, in some embodiments, flexible supporting layer 560 is disposed on an outer surface of top fabric layer 520 such that flexible supporting layer 560 is the topmost layer of hook assembly 500. Similarly, in some embodiments, flexible supporting layer 560 is disposed on an outer surface of bottom fabric layer 550 such that flexible supporting layer 560 is the bottommost layer of hook assembly 500.

As discussed above, hooks 510 are significantly larger than the hooks typically used in bra closure systems. Because of the large size of hooks 510, fewer hooks are necessary to clasp the closure system, which simplifies alignment of the hooks with the loops. For example, while typical closure systems require three to four hooks, the closure systems described herein may only utilize two hooks. However, the closure systems may alternatively include 3 hooks or 4 hooks, depending on the desired design.

In some embodiments, hooks 510 have an aspect ratio of at least 1:1. For example, in some embodiments, length 514 of hooks 510 is approximately equal to width 512 of hooks 510. In some embodiments, hooks 510 have a length 514 of at least 1 cm, and a width 512 of at least 1 cm. In some embodiments, width 512 is in a range of 25% to 30% of a width 505 of hook assembly 500.

Width 512 of hooks 510 may correspond to a length of a loop, for example length 312 of loop 300, shown in FIGS. 3A-3D. In some embodiments, hooks 510 have a flat portion 511 and a curved portion 513, for example as shown in FIG. 5C. In some embodiments, a length 514 of flat portion 511 is greater than a length 516 of curved portion 513. For example, length 514 may be at least two times greater than length 516. In some embodiments, length 516 corresponds to a height of a loop, for example loop 310, described above.

As described previously, the addition of a flexible supporting layer, in conjunction with the large sizes of the loops and the hooks, may increase the case of fastening the closure system and eliminate the need to put the bra on backwards, fasten it, and then turn it around. The rigidity provided by the flexible supporting layer within the hook assembly may enable the wearer to grasp the hook assembly at a point closer to her side because she would not need to provide stability to the hook assembly with her hand. Furthermore, the large loops and hooks may facilitate alignment, which may also prevent the need for the wearer to grasp the hook assembly at a point close to its end, since it may be unnecessary for the wearer's fingers to guide the hooks into the loops.

In some embodiments, the bra and the fabric layers of the loop assembly and the eye assembly are made from the same fabric. However, the bra may be made from a first material, while the fabric layers of the loop assembly and the hook assembly may be made from a second material. In some embodiments, the fabric layers of the loop assembly and the hook assembly are configured to stretch in at least two directions. In some embodiments, the bra and the fabric layers are made from natural materials, for example a single-knit cotton, multi-knit cotton, or hemp; man-made fibers, for example nylon, polyester, suede, microsuede, microfiber, or 3D printed materials; recycled materials, for example plastics or recycled polyesters, or any other material suitable for creating articles of apparel. In some embodiments, the bra and fabric layers are made from a combination of any of the materials described herein.

In some embodiments, the adhesive layers described herein are glue film layers. In some embodiments, the adhesive layers are made from a heat-activated adhesive. In some embodiments, the glue film layers are applied to each body fabric layer using a large glue roll manufacturing assembly. In some embodiments, the glue film layers are applied to each body fabric layer by hand.

In some embodiments the hooks are made from a first material, and the loops are made from a second material. In some embodiments, the hooks and the loops are made from the same material. In some embodiments, the loops and the hooks are made from a metal, for example a metal alloy, a plastic, or any other material suitable for incorporation into an article of apparel.

In embodiments, a bra, including the bras disclosed herein, may also include a moldable contour shaper instead of, or in addition to, underwire structures that are typically included in bras to support and shape breast tissue. As discussed, above, typical underwire structures are formed from a rigid material and have a thin, continuous width. These underwire structures circumscribe the sides and lower edges of the breast tissue. When the underwire structures are flush with the wearer's body, they secure the breast tissue, which aids in restricting movement and keeps the cups of the bra in a desired shape, which helps shape the breast tissue. However, this requires the bra to fit nearly perfectly, because if the breast tissue does not fill the bra cups entirely, the breast tissue will likely sag and pool in the bottom of the cup. This may cause a gap between the breast tissue and the top of the cups, which is visible through clothing. The pooled breast tissue may also overlap the underwire, thereby creating an undesirable shape at the bottom of the breast. Furthermore, these underwire structures often cause discomfort of the wearer because they dig into the wearer's skin, and when the bra becomes worn out over time, the underwire structures can poke through the fabric and poke the wearer.

The moldable contour shapers described herein mitigate the problems caused by conventional underwire structures. For example, the moldable contour shapers described herein may be molded, three-dimensional structures that are configured to bend during wear, and contour the breast tissue without being contoured to the wearer's chest wall. This flexibility may allow a bra to accommodate variations in the bodies of different wearers who may all require the same size bra. The moldable contour shapers may also be thicker than conventional underwire structures, and may accordingly have increased surface areas in relation to conventional underwire structures, which may result in a more even distribution of pressure across the chest of the wearer, which may be particularly beneficial for wearers having increased breast tissue mass.

Figure 7B:
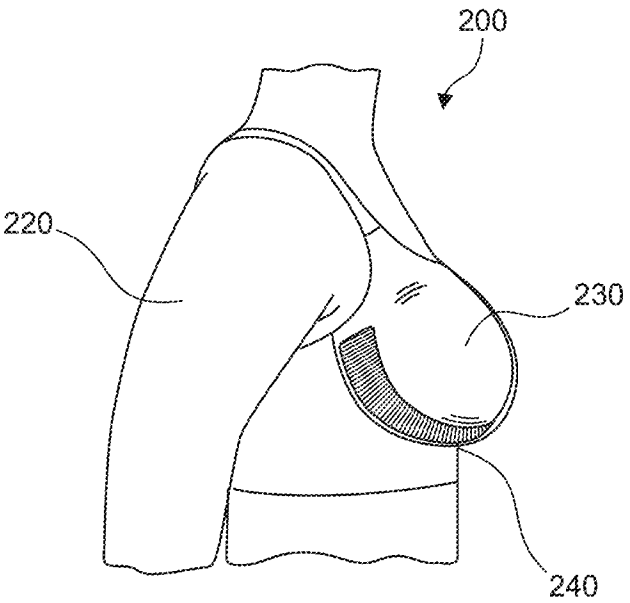
FIG. 7B is a side view of a the bra of FIG. 7A.
Figure 7A:
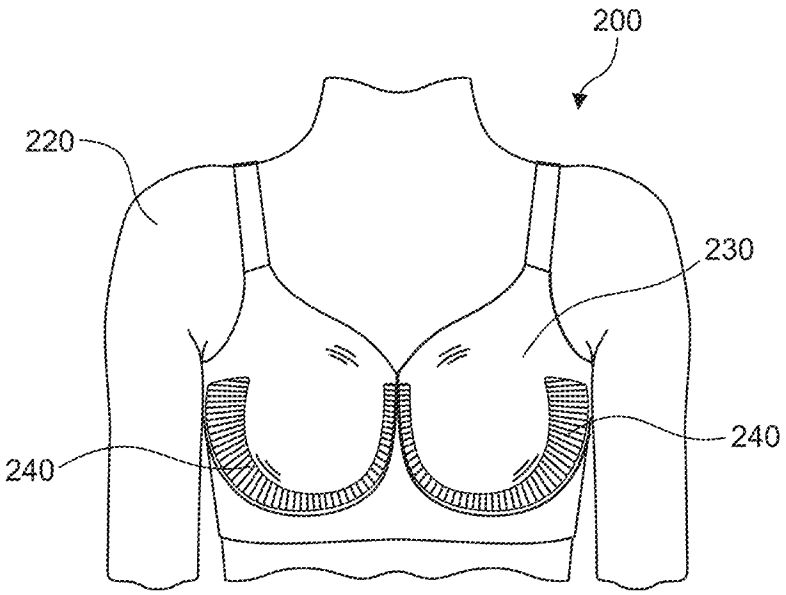
FIG. 7A is a front view of a bra according to some embodiments.
Figure 8:
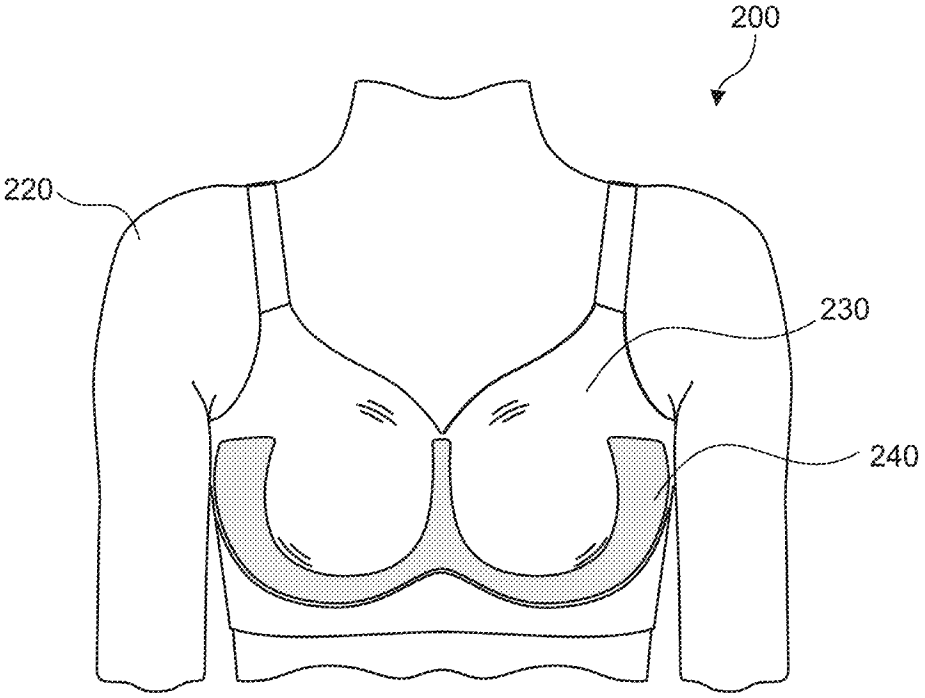
FIG. 8 is a front view of a bra according to some embodiments.

In embodiments, as shown in FIGS. 7A, 7B, and 8, bra 200 may include bra cups 230 with a moldable contour shaper 240 included therein. Moldable contour shaper 240 may be positioned underneath the breast tissue of wearer 220, and may extend upwardly around the sides of the breasts. In some embodiments, moldable contour shaper 240 is a unitary structure, for example as shown in FIG. 8. However, in some embodiments, each bra cup 230 is outfitted individually with a moldable contour shaper 240. The shape and number of moldable contour shapers 240 included in a bra depends on the type of bra and the desired function of the moldable contour shapers. For example, a moldable contour shaper having a unitary structure may be beneficial for use in a sports bra, where a high level of tissue support is desired, since a unitary structure may provide increased stability to the bra. However, bra cups individually including moldable contour shapers may be beneficial for use in a push-up bra, where increased lift is desired, or where one breast requires greater lift than the other due to natural unevenness of the breast tissue.

Moldable contour shaper 240 may have a tapered design such that it is wider around the outside of the breasts, and narrower as it extends under the breasts and around the insides of the breasts. The tapered design may provide increased support to the breast tissue by restricting lateral movement of the breasts, and may also contour the breast tissue by pushing the breasts toward the center of the body, thereby creating a lifted shape as well as cleavage between the breasts.

Moldable contour shaper 240 may be formed in the shape of a "W" when it is a unitary structure, or may be formed in the shape of a "U" for use in individual bra cups. The "W" and "U" shapes of moldable contour shaper 240 may follow a desired outline of the breast tissue, and accordingly, may maintain the breasts in a desired position. Moldable contour shaper 240 may alternatively be formed in any shape desirable for maintaining breast tissue in a certain position. For example, moldable contour shaper 240 may have a custom shape that is individualized for a particular wearer's breast tissue and fit preferences.

In some embodiments, moldable contour shaper 240 has a width in a range of from 0.6 cm to 15 cm, including subranges. For example, contour shaper 240 may have a width of 0.6 cm, 1 cm, 2 cm, 3 cm, 4 cm, 5 cm, 6 cm, 7 cm, 8 cm, 9 cm, 10 cm, 11 cm, 12 cm, 13 cm, 14 cm, 15 cm, or within a range having any two of these values as endpoints, inclusive of the endpoints.

Figure 9:
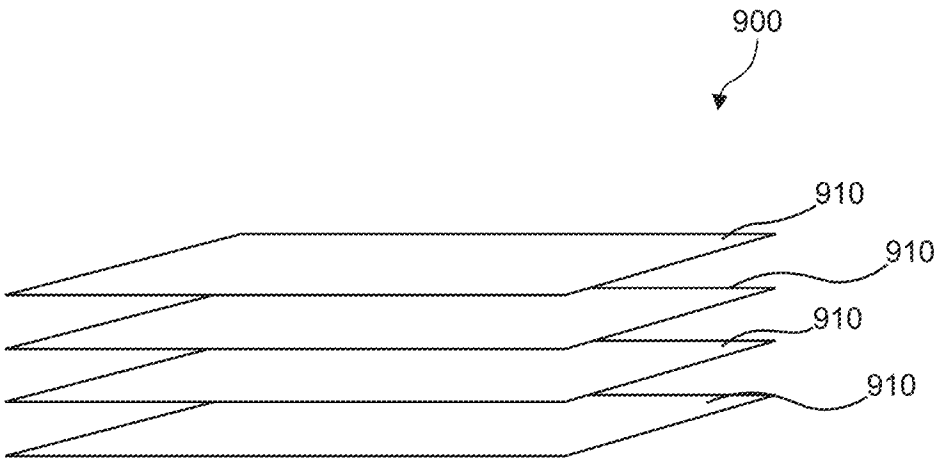
FIG. 9 is an exploded view of a construction of a moldable contour structure according to some embodiments.

In some embodiments, for example as shown in FIG. 9, moldable contour shaper 240 may be made from a plurality of plies 900. Each ply 910 may be made of a different material; however, in some embodiments all of the plies 910 are made of the same material. Each ply 910 may be made from woven carbon, woven nylon, knit nylon, resin, polyurethane, fiberglass, combinations thereof, or any other thermally activated or chemically activated semi-rigid stiffening material that is suitable for use in articles of apparel. In some embodiments, each ply 910 is configured to be placed in an injection mold, and be covered by a resin or an injection molded material during an injection molding process. In some embodiments, one or more of the materials used to make each of the plies 910 is perforated or breathable. The plurality of plies 900 may be created as an initial composite, for example as shown in FIG. 10A, from which a pattern 920 of a moldable contour shaper may be cut, for example into a layered strip or strips.

Pattern 920 may be W-shaped, or U-shaped, for example to create the W-shaped and U-shaped moldable contour shapers described above. However, pattern 920 may be any desirable shape for contouring the breast tissue. For example, pattern 920 may have a half-moon shape, which may be optimized to lift the breast tissue by providing a high level of support underneath the breast.

Figure 10B:
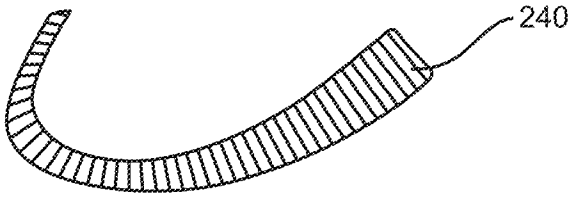
FIG. 10B illustrates a moldable contour shaper cut from the pattern of FIG. 10A.
Figure 10A:
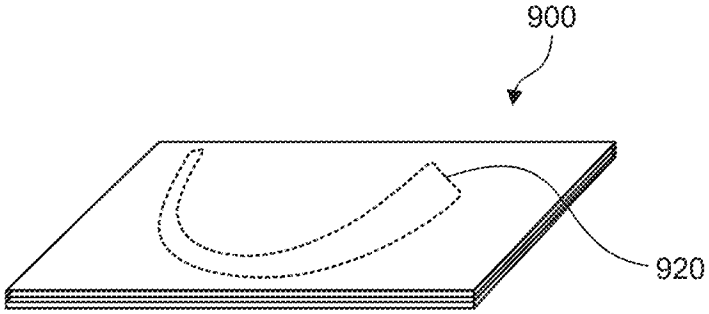
FIG. 10A illustrates a pattern for a moldable contour shaper according to some embodiments.

Plies 900 may then be cut, placed in a mold, heated, chemically activated, or placed in an injection mold to activate the thermally-activated properties of each individual ply 910, and then cooled to set the shape of the resulting moldable contour shaper 240, for example as shown in FIG. 10B. After molding, the shape of moldable contour shaper 240 may shift from having a substantially flat configuration, for example as shown in FIG. 10A to a three-dimensional configuration, for example as shown in FIG. 10B. The three-dimensional shape of molded moldable contour shaper 240 allows for moldable contour shaper 240 to follow the shape of the bra cups, thereby providing rigidity to the bra cups, which may enhance the bra's ability to hold the breast tissue in a desired position. The curvature of moldable contour shaper 240 may be dependent upon the shape of the mold used.

Figure 11B:
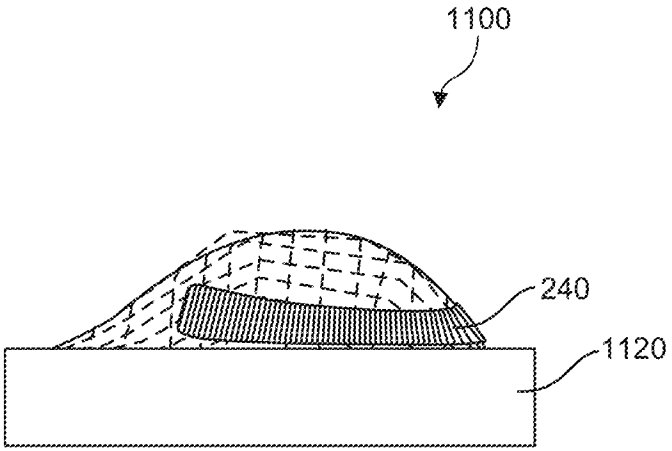
FIG. 11B is a side view of the mold head of FIG. 11A.
Figure 11A:
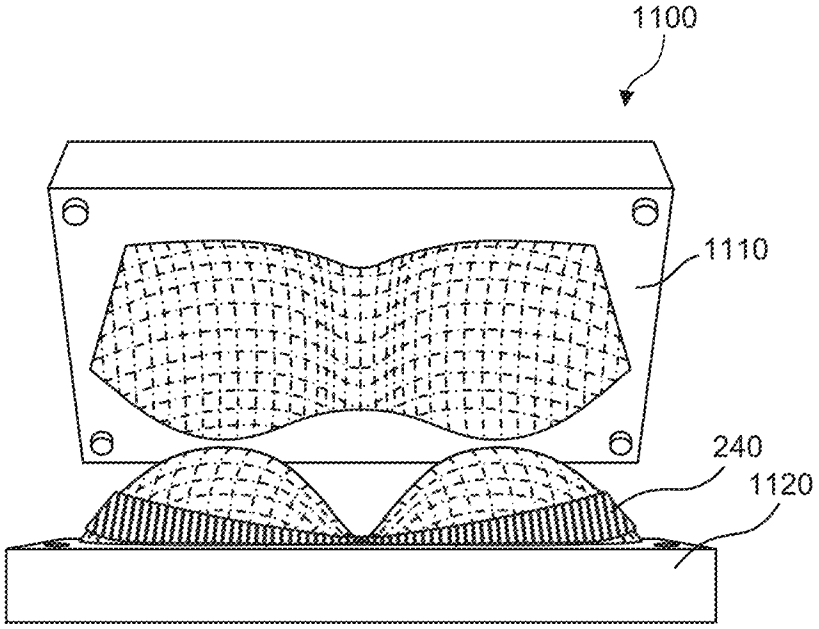
FIG. 11A is a perspective view of a mold head used to shape a moldable contour shaper according to some embodiments.

FIGS. 11A and 11B illustrate a mold assembly 1100 which may be used to thermoform plies 900. For example, the cut plies may be placed on a bottom mold 1120, which may be formed in the shape of breasts. Top mold 1110 may be placed on top of bottom mold 1120, thereby sandwiching the plies between each mold, and creating the desired final shape of the resulting moldable contour shaper 240. Mold assemblies of various shapes and sizes may be used to accommodate bras having different styles and sizes. The plies may alternatively be shaped by an injection mold, a 3D printed mold, or an open mold assembly.

Figure 12:
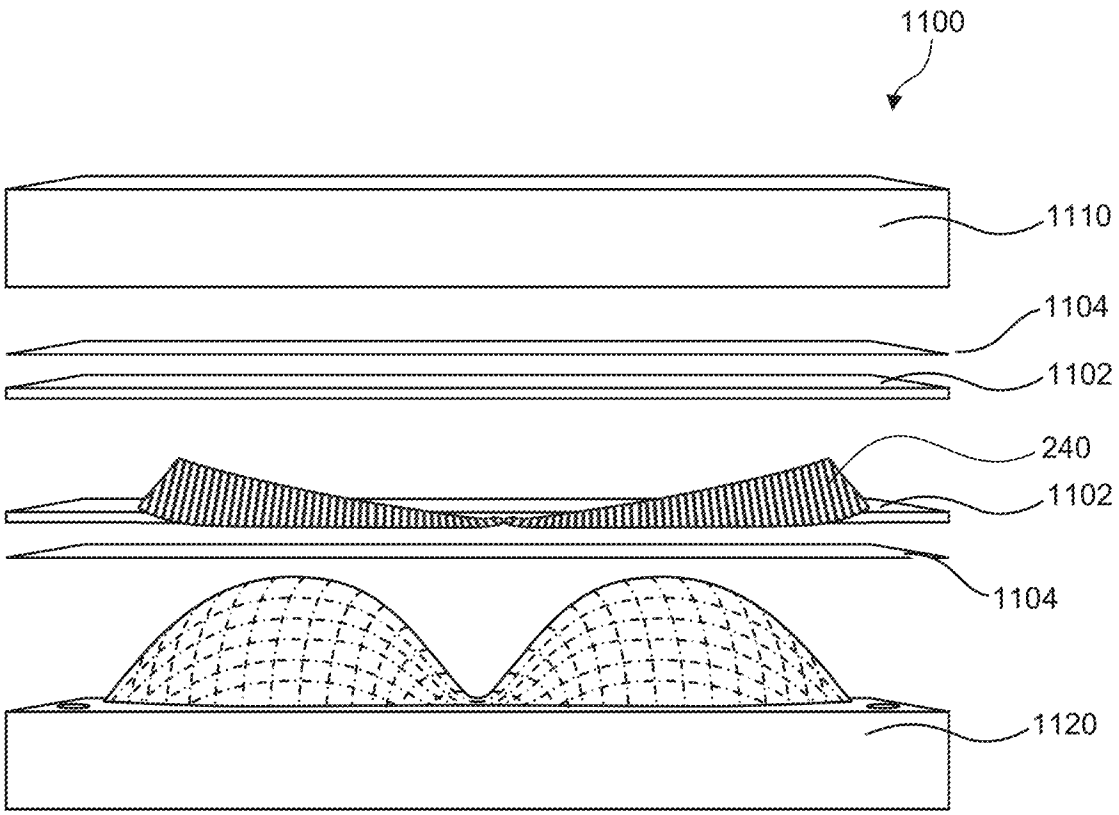
FIG. 12 is an exploded view of a molding assembly according to some embodiments.

In some embodiments, mold assembly 1100 is a mold assembly that may be used for manufacturing the bra cups. By using the same mold for production of both the moldable contour shaper and the bra cups, the cost of specific mold creation is reduced, and the moldable contour shaper is guaranteed to fit perfectly into the cups. For example, as shown in FIG. 12, moldable contour shaper 240 may be disposed between two foam layers 1102, which are in between two fabric layers 1104. The same mold assembly 1100 used to form the moldable contour shaper may be used to form the foam layers 1102 into cups with moldable contour shaper(s) 240 incorporated therein.

Figure 13B:
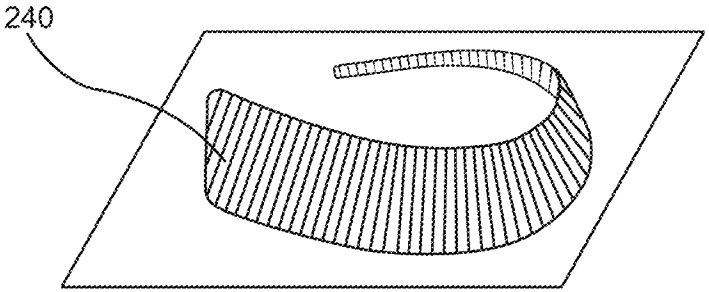
FIG. 13B is a perspective view of the molded moldable contour shaper of FIG. 13A.
Figure 13A:
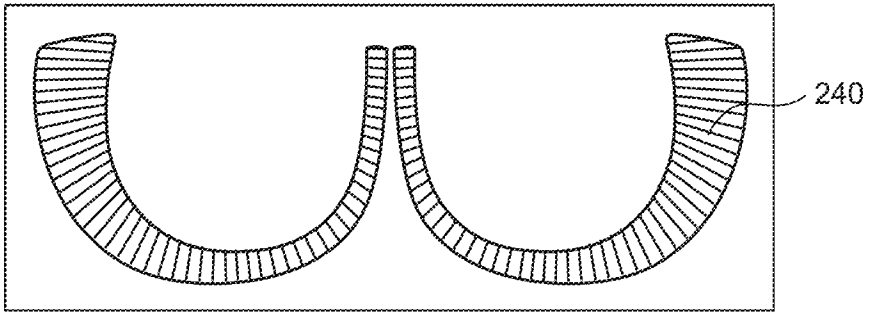
FIG. 13A is a front view of a molded moldable contour shaper according to some embodiments.
Figure 14B:
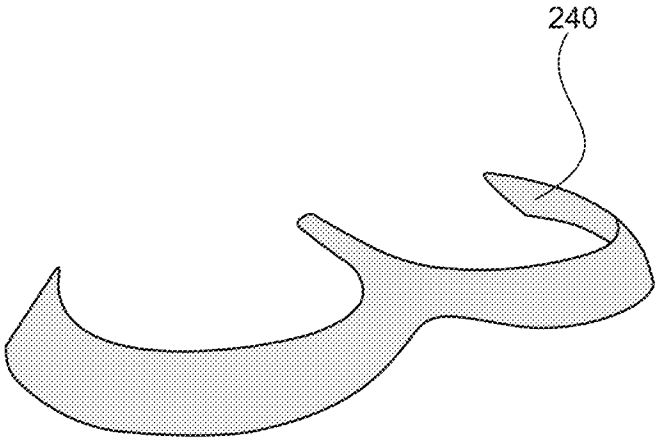
FIG. 14B is a perspective view of the molded moldable contour shaper of FIG. 13A.
Figure 14A:
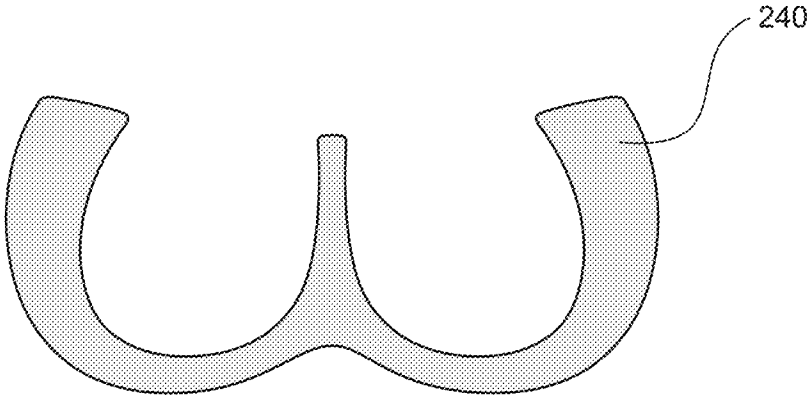
FIG. 14A is a front view of a molded moldable contour shaper according to some embodiments.

As discussed above, in some embodiments moldable contour shaper 240 includes two individual structures, for example as shown in FIGS. 13A and 13B. The individual moldable contour shapers 240 may be the same size, or may have different sizes to accommodate for uneven breast tissue. However, in some embodiments moldable contour shaper 240 is a single, continuous structure configured to support both breasts, for example as shown in FIGS. 14A and 14B.

Figure 15B:
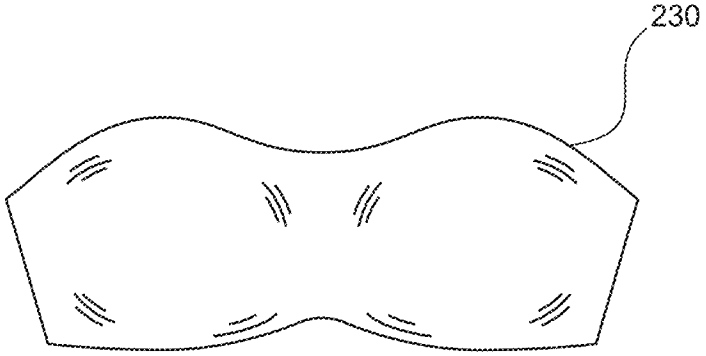
FIG. 15B is a front view of the molded bra cup of FIG. 18A after removal of excess fabric.
Figure 15A:
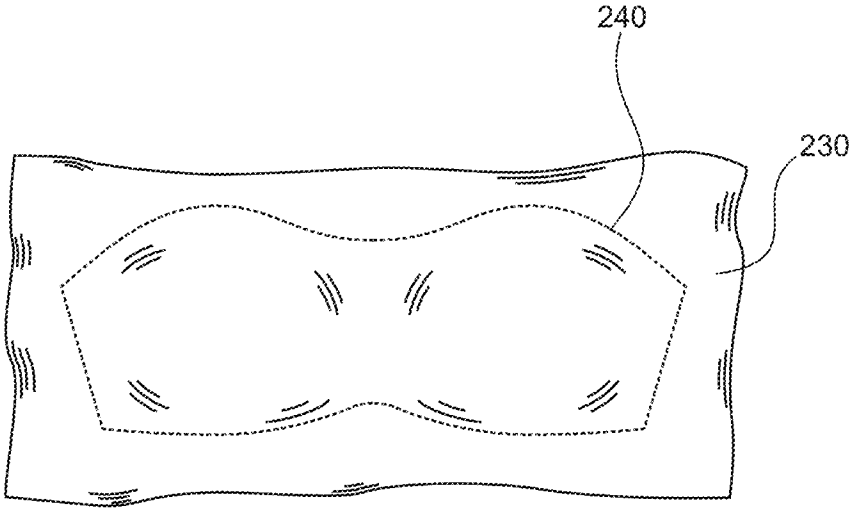
FIG. 15A is a front view of a molded bra cup according to some embodiments.

After molding, excess fabric 260 may be cut from cups 230 to create a finalized cup structure for incorporation into a bra, for example as shown in FIGS. 15A and 15B.

Figure 16:
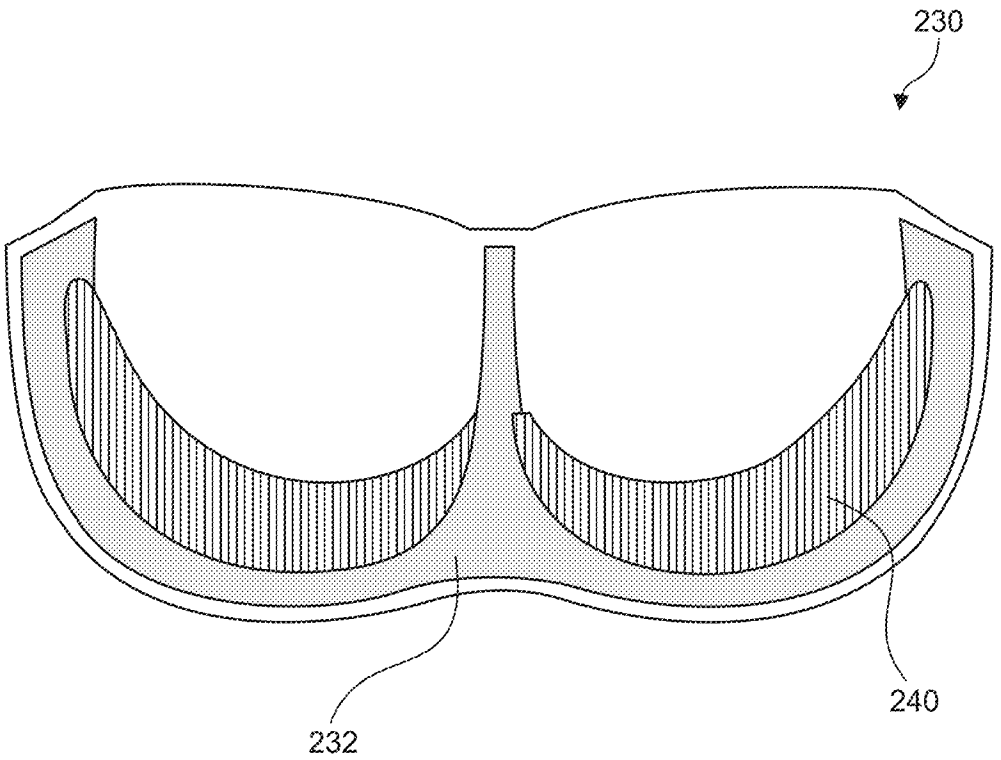
FIG. 16 is an inside view of stretched bra cups according to some embodiments.
Figure 17:
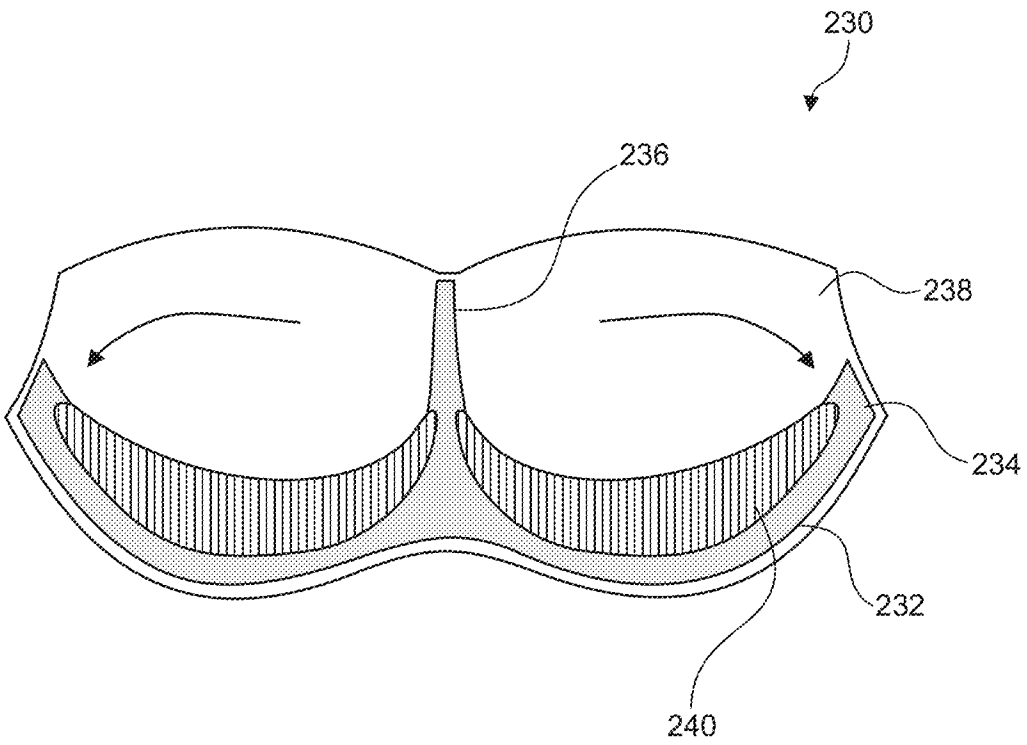
FIG. 17 is an inside view of relaxed bra cups according to some embodiments.

The bras described herein may be configured to stretch to fit a wearer's body. For example, FIG. 16 illustrates an inside view of bra cups 230 in an unstretched state, while FIG. 17 illustrates the bra cups 230 in a stretched configuration.

In some embodiments, bra cups 230 include a high impact absorber foam 232 disposed beneath moldable contour shaper 240. The high impact absorber foam 232 may provide cushioning beneath the breast tissue to decrease impact during physical activity, thereby increasing comfort of the wearer. High impact absorber foam may be made from a dense foam, a compressed foam, an open cell foam, a closed cell foam, or any other foam suitable for use in an article of apparel.

In some embodiments, bra cups 230 may also include a high stretch recovery foam 238 disposed at the top of the cups. High stretch recovery foam 236 may provide cushioning to the wearer, and may also be configured to stretch up to 50% of its original length and up to 50% of its original width.

In some embodiments, bra cups 230 include flared contouring 234 at the underarm. Flared contouring 234 may be designed to provide enhanced comfort of the wearer by preventing cups 230 from extending into the wearer's underarms.

In some embodiments, bra cups 230 include high center front anchors 236, extending from the high impact absorber foam 232. Front anchors 236 may be configured to better cushion the chest and aid in impact absorption between the breasts.

Figure 18:
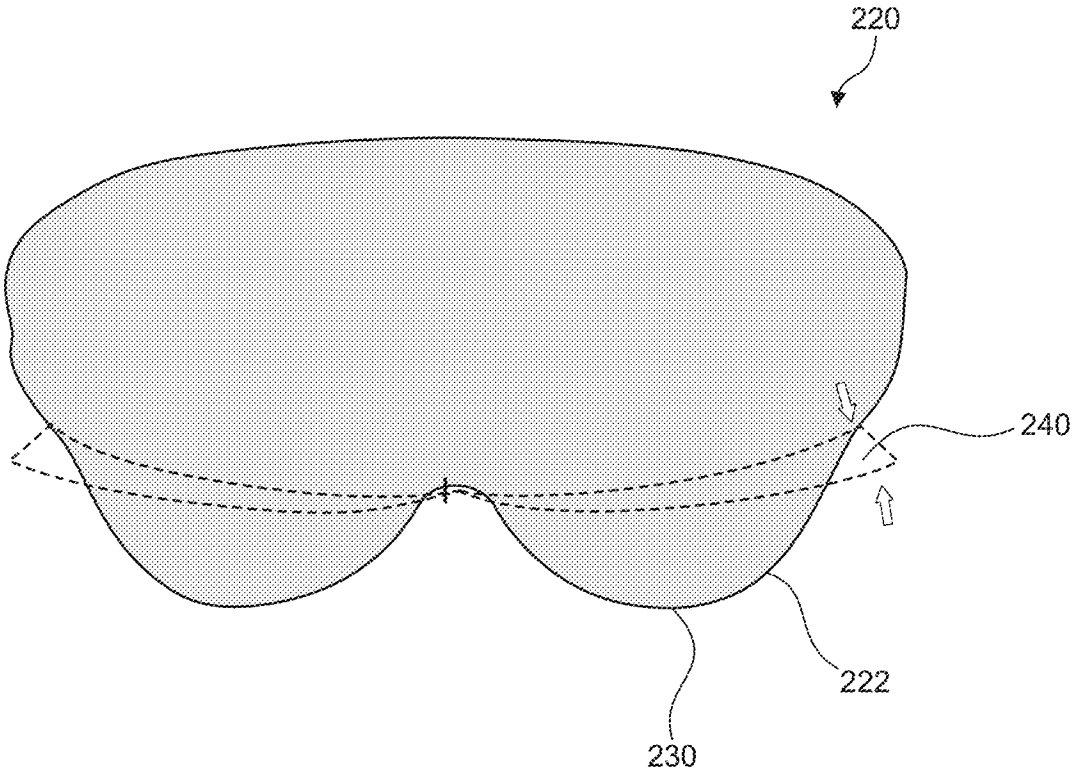
FIG. 18 illustrates a top view of a contour of a bra against a body according to some embodiments.

In some embodiments, when bra cups 230 are stretched to fit the body, for example as shown in FIG. 18, moldable contour shaper 240 may sit against the chest of wearer 220, and the tapered structure of moldable contour shaper 240 may push the breast tissue 222 of wearer 220 into the cups 230, thereby filling the entire volume of the cups. By filling the entire volume of the cups 230 with the breast tissue 222, the breasts may follow the shape of the cups, resulting in a contoured appearance.

Although the bra cups described herein have been described in the context of a bra, they could be incorporated into other articles of apparel, for example bathing suits, shirts, compression garments, or other garments.

Some embodiments are directed to a bra including a closure system, the closure system including a first layered fabric body, a second layered fabric body, a loop assembly secured to the first layered fabric body, and a hook assembly secured to the second layered fabric body, where the hook assembly is configured to interface with the loop assembly to secure the first layered fabric body to the second layered fabric body, where the second layered fabric body comprises a flexible supporting layer, and where the flexible supporting layer is configured to provide rigidity to the second layered fabric body such that the second layered fabric body maintains a flat configuration when it is secured to the first layered fabric body.

In any of the various embodiments discussed herein, the hook assembly is coupled to the flexible supporting layer.

In any of the various embodiments discussed herein, the loop assembly includes a plurality of loops, where each of the loops has an aspect ratio of at least 2:1.

In any of the various embodiments discussed herein, the hook assembly includes a plurality of hooks, wherein each of the hooks has an aspect ratio of at least 1:1.

In any of the various embodiments discussed herein, the second layered fabric body is configured to overlap the first layered fabric body.

In any of the various embodiments discussed herein, the loop assembly comprises a plurality of loops, wherein each of the loops extends perpendicularly outward from a top surface of the first layered fabric body.

Some embodiments are directed to a closure system for a bra, the closure system including a loop assembly secured to a first layered fabric body, the first layered fabric body including a top fabric layer, a top adhesive layer disposed on a bottom face of the top fabric layer; a bottom fabric layer; a bottom adhesive layer disposed on a top face of the bottom fabric layer, and a cushioning layer disposed between the top adhesive layer and the bottom adhesive layer, where the top adhesive layer and the bottom adhesive layer are configured to secure the flexible supporting layer between the top fabric layer and the bottom fabric layer; and a hook assembly secured to a second layered fabric body, the second layered body including a top fabric layer, a top adhesive layer disposed on a bottom face of the top fabric layer, a bottom fabric layer, a bottom adhesive layer disposed on a top face of the bottom fabric layer, and a flexible supporting layer disposed between the top adhesive layer and the bottom adhesive layer, where the top adhesive layer and the bottom adhesive layer are configured to secure the flexible supporting layer between the top fabric layer and the bottom fabric layer, and where the hook assembly is configured to interface with the loop assembly to secure the first layered fabric body to the second layered fabric body.

In any of the various embodiments discussed herein, the flexible supporting layer has a length in a range of 5 cm to 20 cm.

In any of the various embodiments discussed herein, the flexible supporting layer has a width in a range of 1 cm to 20 cm.

In any of the various embodiments discussed herein, the loop assembly includes a plurality of loops assembled in rows evenly spaced apart along the length of the first layered fabric body.

In any of the various embodiments discussed herein, the top fabric layer of the first layered fabric body and the bottom fabric layer of the first layered fabric body are sewn together, bonded together, laminated together, or ultrasonically attached to each other.

In any of the various embodiments discussed herein, the top fabric layer of the second layered fabric body and the bottom fabric layer of the second layered fabric body are sewn together, bonded together, laminated together, or ultrasonically attached to each other.

In any of the various embodiments discussed herein, the hook assembly includes a plurality of hooks extending through slits in the top fabric layer of the second layered fabric body.

In any of the various embodiments discussed herein, each of the top fabric layer of the first layered fabric body, the bottom fabric layer of the first layered fabric body, the top fabric layer of the second layered fabric body, and the bottom fabric layer of the second layered fabric body are configured to stretch in at least two directions.

In any of the various embodiments discussed herein, the flexible supporting layer is perforated.

In any of the various embodiments discussed herein, the flexible supporting layer is made of TPU.

Some embodiments are directed to a bra, including a closure system, the closure system including a first layered fabric body, a second layered fabric body, a loop assembly secured to the first layered fabric body, the loop assembly including a plurality of loops, wherein each of the loops comprises an aspect ratio of at least 2:1, a hook assembly secured to the second layered fabric body, the hook assembly including a plurality of hooks, wherein each of the hooks comprises an aspect ratio of at least 1:1, where the hook assembly is configured to interface with the loop assembly to secure the first layered fabric body to the second layered fabric body, where the second layered fabric body comprises a flexible supporting layer, and where each of the loops extends perpendicularly outward from a top surface of the first layered fabric body.

In any of the various embodiments discussed herein, the hook assembly is coupled to the flexible supporting layer in a fixed way.

In any of the various embodiments discussed herein, each of the hooks has a width within a range of 25% to 30% of a width of the second layered fabric body.

In any of the various embodiments discussed herein, each of the hooks has a flat portion and a curved portion, and where each of the flat portions has a length greater than a length of each of the curved portions.

In any of the various embodiments discussed herein, the loop assembly and the hook assembly each are made of a metal alloy.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A bra, comprising
- a first panel and a second panel; and
- a closure system configured to join the first panel and the second panel, the closure system comprising:
  - a first layered fabric body comprising a top layer, a middle layer, and a bottom layer;
  - a second layered fabric body;
  - a loop assembly secured to the first layered fabric body, wherein the loop assembly comprises loops, wherein a first portion of each loop is disposed between the top layer and the middle layer, and wherein a second portion of each loop extends through the top layer; and
  - a hook assembly secured to the second layered fabric body, wherein the hook assembly is configured to interface with the loop assembly to secure the first layered fabric body to the second layered fabric body.

2. The bra of claim 1, wherein the first portion of each loop is angled relative to the second portion of each loop.

3. The bra of claim 2, wherein the first portion is parallel to the top layer, and wherein the second portion is angled between about 30° and about 90° relative to the top layer.

4. The bra of claim 1, further comprising a first bra cup, the first bra cup comprising a moldable contour shaper.

5. The bra of claim 1, wherein the top layer comprises fabric, the middle layer comprises foam, and the bottom layer comprises fabric.

6. The bra of claim 1, wherein the bottom layer is a skin-contact layer.

7. The bra of claim 1, wherein the hook assembly comprises hooks configured to engage with the loops.

8. The bra of claim 7, wherein the second layered fabric body comprises a top layer comprising fabric, a middle layer, and a bottom layer comprising fabric.

9. The bra of claim 8, wherein the hooks extend through the top layer of the second layered fabric body.

10. The bra of claim 8, wherein the middle layer is a flexible supporting layer, and wherein the hook assembly comprises hooks fixed to the middle layer.

11. The bra of claim 10, wherein the flexible supporting layer comprises slots or perforations.

12. A bra, comprising
- a first panel and a second panel; and
- a closure system configured to join the first panel and the second panel, the closure system comprising:
  - a first layered fabric body comprising a top layer, a middle layer, and a bottom layer;
  - a second layered fabric body;
  - a loop assembly secured to the first layered fabric body, wherein the loop assembly comprises loops having an aspect ratio of 2:1 and extending perpendicular outward from the top layer, wherein each loop comprises a first end and a second end, and wherein each loop is coupled the top layer at the first end and at the second end,
  - a hook assembly secured to the second layered fabric body, wherein the hook assembly is configured to interface with the loop assembly to secure the first layered fabric body to the second layered fabric body.

13. The bra of claim 12, wherein the loops are evenly spaced along a length of the loop assembly.

14. The bra of claim 12, wherein the loops are arranged in rows along a length of the loop assembly.

15. The bra of claim 12, wherein the hook assembly comprises hooks configured to be inserted into the loops between the first end and the second end of the loops.

16. A bra, comprising:
- a first fabric layer and a second fabric layer that define a first bra cup and a second bra cup, wherein the first fabric layer and the second fabric layer are made of a first material;
- a moldable contour shaper configured to contour to a wearer's breast tissue,
  - wherein the moldable contour shaper is disposed between the first fabric layer and the second fabric layer,
  - wherein a width of the moldable contour shaper at a first portion is greater than a width of the moldable contour shaper at a second portion, and wherein the moldable contour shaper comprises a second material that is different than the first material.

17. The bra of claim 16, further comprising a second moldable contour shaper disposed between the first fabric layer and the second fabric layer, wherein the moldable contour shaper is disposed in the first bra cup and the second moldable contour shaper is disposed in the second bra cup.

18. The bra of claim 17, wherein the moldable contour shaper and the second moldable contour shaper are continuous with each other.

19. The bra of claim 17, wherein the moldable contour shaper and the second moldable contour shaper are independently moldable.

20. The bra of claim 16, wherein the moldable contour shaper does not contour to the wearer's chest wall.

21. The bra of claim 16, wherein the moldable contour shaper comprises a first ply and a second ply.

* * * * *